US005390804A

United States Patent [19]

Beggins

[11] Patent Number: 5,390,804

[45] Date of Patent: Feb. 21, 1995

[54] BULLET-NOSED LONGNECK BOTTLE COOLER APPARATUS

[75] Inventor: Thomas M. Beggins, San Juan Capistrano, Calif.

[73] Assignee: Wallis H. Wallis, San Juan Capistrano, Calif.

[21] Appl. No.: 229,366

[22] Filed: Apr. 18, 1994

[51] Int. Cl.[6] ..... B65D 23/08

[52] U.S. Cl. ..... 215/100 R; 215/12.1; 215/13.1; 220/737; 220/739; 220/903

[58] Field of Search ..... 215/12.1, 13.1, 100 R, 215/100.5, 11.6; 220/675, 903, 737, 739, 8; 150/154, 901; 62/457.1, 457.4, 457.8

[56] References Cited

U.S. PATENT DOCUMENTS

| | | | |
|---|---|---|---|
| 995,700 | 7/1910 | Maynard . | |
| 1,744,498 | 1/1930 | Payson et al. | 215/12.1 |
| 1,999,670 | 4/1935 | Strouse et al. . | |
| 2,556,893 | 6/1951 | Zwiebach et al. . | |
| 2,773,358 | 12/1956 | Palmer et al. . | |
| 2,805,556 | 10/1957 | Wang . | |
| 2,889,065 | 6/1959 | Lawlor | 215/12.1 |
| 3,120,319 | 2/1964 | Buddrus | 220/903 X |
| 3,155,260 | 11/1964 | Widener | 220/903 X |
| 3,229,840 | 1/1966 | Filleul | 215/12.1 X |
| 3,302,428 | 2/1967 | Stoner et al. | 220/903 X |
| 3,553,976 | 1/1971 | Cumine et al. . | |
| 3,613,761 | 10/1971 | Moody | 220/903 X |
| 3,779,298 | 12/1973 | Piccirilli et al. | 215/13 R X |
| 3,910,328 | 10/1975 | Marcoux | 220/903 X |
| 3,987,643 | 10/1976 | Willis | 62/371 |
| 3,998,072 | 12/1976 | Shaw | 62/457 |
| 4,114,759 | 9/1978 | Maloney, Jr. | 220/675 X |
| 4,240,272 | 12/1980 | Tiede et al. | 215/12.1 |
| 4,281,520 | 8/1981 | Norwood | 62/372 |
| 4,300,612 | 11/1981 | Schroeder, Jr. et al. | 220/675 X |
| 4,456,134 | 6/1984 | Cooper | 215/12.1 |
| 4,510,769 | 4/1985 | McClellan, Jr. | 215/13.1 X |
| 4,708,254 | 11/1987 | Byrns | 220/903 X |
| 4,811,858 | 3/1989 | Augur | 215/13.1 |

FOREIGN PATENT DOCUMENTS

| | | | |
|---|---|---|---|
| 1251744 | 3/1989 | Canada | 220/903 |
| 846816 | 9/1939 | France | 215/13.1 |
| 1013815 | 8/1952 | France | 215/13.1 |
| 2616502 | 10/1977 | Germany | 215/13.1 |
| 3534103 | 4/1987 | Germany | 215/13.1 |
| 990011 | 4/1965 | United Kingdom | 215/13.1 |

*Primary Examiner*—Sue A. Weaver
*Attorney, Agent, or Firm*—Price, Gess & Ubell

[57] ABSTRACT

An insulating device for longneck bottles having a lower cylindrical enclosure which telescopically receives an upper enclosure having a dome-shaped upper end and an opening therein of a diameter selected to determine the extent to which the upper enclosure slides down the bottle neck and hence the extent to which the upper enclosure extends into the lower enclosure.

4 Claims, 1 Drawing Sheet

BULLET-NOSED LONGNECK BOTTLE COOLER APPARATUS

BACKGROUND OF THE INVENTION

1. Field of the Invention

The subject invention relates to apparatus for maintaining cold containerized liquids in a cool state and, more particularly, to a two-part telescopic lightweight portable cooler apparatus for longneck bottles.

2. Description of Related Art

A number of structures for insulating containers have been proposed in the prior art. Perhaps the most familiar is the cylindrical foam jackets or sleeves conventionally used to cool standard cylindrical cans containing beer, soda, and the like. Such devices are plainly inadequate for so-called "longneck" bottle structures. Various other insulating structures exhibit practical drawbacks in that they often leave the bottle contents partially exposed to the air and/or employ cumbersome attachments mechanisms such as mechanical clasps or snaps.

OBJECTS AND SUMMARY OF INVENTION

Accordingly, it is an object of the invention to provide an improved insulating apparatus;

It is another object of the invention to provide such an insulating apparatus particularly adapted for convenient use with longneck bottles;

It is another object of the invention to provide such an apparatus that is readily manufactured and easily used;

It is another object of the invention to provide an insulating structure for a longneck bottle which is particularly pleasing in appearance.

The invention contemplates a lower cylindrical enclosure and an upper enclosure which telescopically fits into the lower enclosure. The lower enclosure is closed at one end and open at the other end for receiving the lower end of a longneck bottle. The upper enclosure has a domed upper end which unitarily forms into a cylindrical lower section. This lower cylindrical section telescopically fits into the opening in the lower cylindrical enclosure. An opening is formed in the upper domed portion and is sized to pass over the capped end of a longneck bottle and slide partially down the neck of the bottle until the neck of the bottle reaches a diameter which stops further progress.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide readily manufacturable, easily used and aesthetically pleasing longneck bottle insulating apparatus.

The cooler apparatus 11 of the preferred embodiment includes a lower cylindrical enclosure 15 and an upper enclosure 13. The upper enclosure 13 and the lower enclosure 15 are preferably formed of a relatively rigid foam material such as styrofoam, which provides structural integrity as well as insulating properties.

Figure 1:
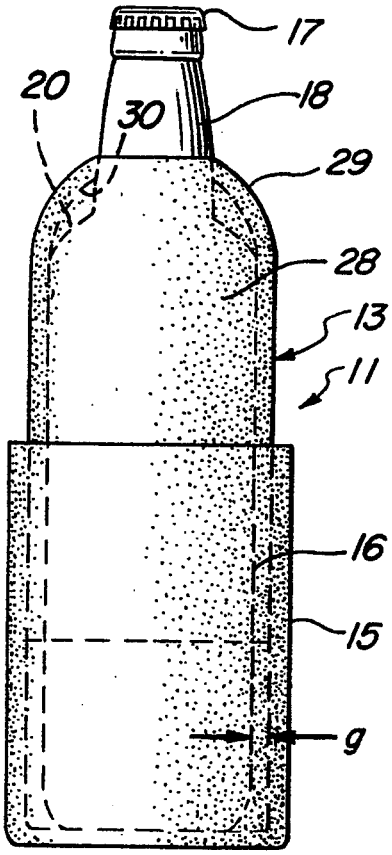
FIG. 1 is a front elevational view illustrating the preferred embodiment of the invention.
Figure 2:
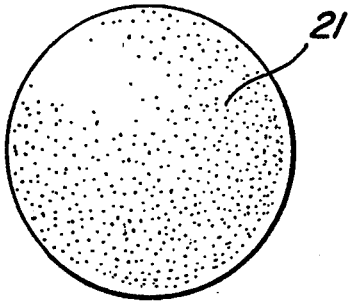
FIG. 2 is a bottom view of the embodiment of FIG. 1.
Figure 3:
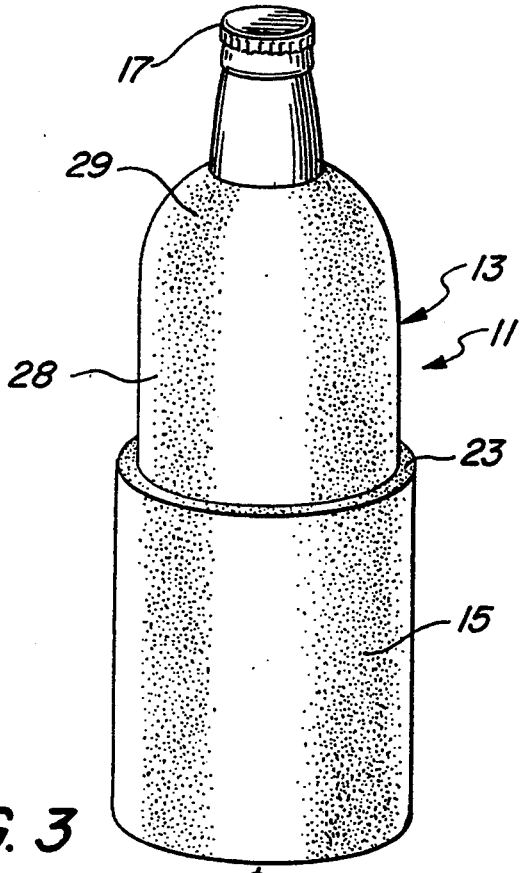
FIG. 3 is a perspective view of the preferred embodiment.
Figure 4:
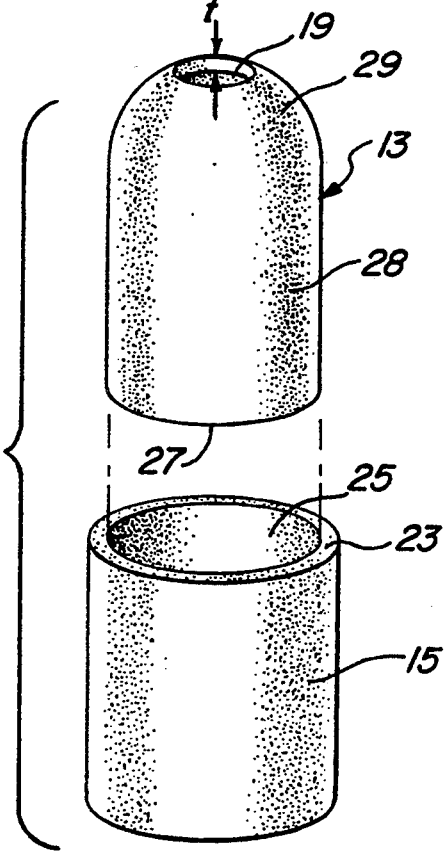
FIG. 4 is an exploded view of a cooler cup according to the preferred embodiment.

As shown in FIG. 1, these enclosures 13, 15 are installed about a longneck bottle 17. The bottle 17 has a neck 18 which generally increases in diameter from the top capped portion of the bottle to the shoulder 20 of the bottle 17.

The lower enclosure 15 comprises a cylinder having an inner cylindrical surface 25, a flat enclosed bottom 21 and upper rim 23. The upper enclosure 13 includes a dome-shaped or "bullet-nose" upper end 29 which is integrally and unitarily formed into a lower cylindrical section 28 terminating in a circular rim 27. The upper enclosure 13 is generally of a uniform thickness "t" and includes a circular opening 19 formed in the dome-shaped upper end 29.

The circular rim 27 of the upper enclosure 13 is of a diameter selected to fit telescopically into the circular opening of the lower enclosure 15 defined by its upper rim 23. The diameter of the rim 27 is further preferably selected to provide a slight interference fit which causes a snug engagement between the lower enclosure 15 and the upper enclosure 13 when they are telescopically interfitted. This interference fit holds the two enclosure parts 13, 15 together despite a gap "g" (FIG. 1) between the lower cylinder sidewall 25 and the outer wall 16 of the longneck bottle 17.

The diameter of the opening 19 in the bullet-nosed dome 29 is also of a specially selected size. In particular, the diameter of opening 19 is selected such that the opening 19 will initially pass over the capped end of the bottle 17 and slide down over the bottle neck 18 to the point where the diameter of the neck 18 precludes further sliding. The diameter selected for the opening 19 thus determines the extent to which the lower cylindrical section 28 of the upper enclosure 13 extends into the lower enclosure 15. As illustrated, for example, in FIG. 1, this mechanism for determining the position of the upper enclosure 13 permits the use of a dome-shaped configuration for the upper end 29 of the upper enclosure 13, despite a considerable resulting gap between the shoulder 20 of the longneck bottle 17 and the interior surface 30 of the dome-shaped portion 29.

Thus, in operation, the lower end of a longneck bottle 17 is placed into the lower enclosure 15. The upper enclosure 13 is then installed, by passing the opening 19 over the bottle neck 18, while simultaneously pressing the lower cylindrical section 28 into the lower enclosure 15. The downward progress of the upper enclosure 15 stops when the opening 19 reaches a point where it comes into a locking relation with the neck 18 of the bottle 17. Thus, a two-part, telescopic, lightweight, portable cooler apparatus for longneck bottles is provided. This apparatus completely encloses the cooled contents of such bottles and maintains the contents in the cooled state, while permitting the contents to be readily imbibed.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A cooler apparatus for a longneck bottle having a neck which increases in diameter down its length comprising:

a lower cylindrical enclosure having a closed end and a circular upper rim defining a circular opening into a cylindrical interior for receiving the end of said bottle;

an upper enclosure having a dome-shaped upper end unitarily and integrally forming into a lower cylindrical section, the lower cylindrical section terminating in a circular rim sized in diameter to telescopically interfit into the interior cylindrical surface of said lower enclosure while simultaneously providing an interference fit between cylindrical portions of said upper and lower enclosures;

said upper dome-shaped portion including a circular opening therein sized in diameter to pass over the top of said bottle and come into a locking relation with the neck of said bottle at a selected diameter along said neck, said locking relation preventing further downward progress of said upper dome-shaped portion along said neck, the diameter of said opening being determined to define the extent to which the lower cylindrical section of said upper enclosure extends into said lower cylindrical enclosure.

2. The cooler apparatus of claim 1 wherein said bottle is spaced apart from said cylindrical interior by a distance equal to the thickness of said upper enclosure.

3. The cooler apparatus of claim 2 wherein said opening is further selected to create a gap between the shoulder of said bottle and the interior of said dome-shaped upper end.

4. The cooler apparatus of claim 1 wherein said upper and lower enclosures are constructed of a foam material.

* * * * *